US009316948B2

(12) United States Patent
Tsukijima et al.

(10) Patent No.: US 9,316,948 B2
(45) Date of Patent: Apr. 19, 2016

(54) DEVELOPING APPARATUS WITH DISCHARGE REGULATING MEMBER

(71) Applicant: CANON KABUSHIKI KAISHA, Tokyo (JP)

(72) Inventors: Hisashi Tsukijima, Toride (JP); Yusuke Ishida, Toride (JP); Takanori Iida, Noda (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/548,773

(22) Filed: Nov. 20, 2014

(65) Prior Publication Data

US 2015/0139697 A1 May 21, 2015

(30) Foreign Application Priority Data

Nov. 21, 2013 (JP) ..... 2013-240731

(51) Int. Cl.
*G03G 15/08* (2006.01)
*G03G 21/10* (2006.01)

(52) U.S. Cl.
CPC ..... *G03G 15/0893* (2013.01); *G03G 21/10* (2013.01); *G03G 2215/083* (2013.01)

(58) Field of Classification Search
CPC ..... G03G 15/0893; G03G 21/105
See application file for complete search history.

(56) References Cited

U.S. PATENT DOCUMENTS

| | | | | |
|---|---|---|---|---|
| 7,483,657 | B2 | 1/2009 | Ishida | |
| 7,536,120 | B2 | 5/2009 | Ishida | |
| 7,734,206 | B2 | 6/2010 | Ishida | |
| 7,991,332 | B2 * | 8/2011 | Sakamaki | 399/257 |
| 8,213,836 | B2 * | 7/2012 | Kato et al. | 399/254 |
| 8,295,741 | B2 | 10/2012 | Kido | |
| 8,649,708 | B2 | 2/2014 | Watanabe et al. | |
| 8,867,967 | B2 | 10/2014 | Yamauchi et al. | |
| 2013/0177338 | A1 | 7/2013 | Iida | |
| 2015/0003876 | A1 | 1/2015 | Iida et al. | |

FOREIGN PATENT DOCUMENTS

| | | | |
|---|---|---|---|
| JP | 2001-265098 | A | 9/2001 |
| JP | 2010-224105 | A | 10/2010 |
| JP | 2010-237329 | A | 10/2010 |
| JP | 2010237329 | A * | 10/2010 |

(Continued)

OTHER PUBLICATIONS

Yusuke Ishida et al., U.S. Appl. No. 14/534,707, filed Nov. 6, 2014, Art Unit 2852.

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

A developing apparatus includes a developing container for containing a developer comprising toner and carrier and first and second rotatable feeding members configured to feed the developer. The first feeding member includes a rotatable shaft, a first helical blade portion provided around the rotatable shaft and configured to feed the developer, and a second helical blade portion provided around the rotatable shaft at a position downstream of the first helical blade portion. The second helical blade portion has a helix which is opposed to that of the first helical blade portion. In addition, a disk portion is provided on the rotatable shaft at a position between the first helical blade portion and the second helical blade portion.

8 Claims, 9 Drawing Sheets

(56) References Cited

FOREIGN PATENT DOCUMENTS

| | | | | |
|---|---|---|---|---|
| JP | 2010-256701 | A | | 11/2010 |
| JP | 2011-128518 | A | | 6/2011 |
| JP | 2011-128527 | A | | 6/2011 |
| JP | 2012-047988 | A | | 3/2012 |
| JP | 2012-159816 | A | | 8/2012 |
| JP | 2012155144 | A | * | 8/2012 |
| JP | 2013025123 | A | * | 2/2013 |

* cited by examiner (a)

(b)

DEVELOPING APPARATUS WITH DISCHARGE REGULATING MEMBER

FIELD OF THE INVENTION AND RELATED ART

The present invention relates to a developing apparatus which is mounted in an electrophotographic image forming apparatus or the like to develop an electrostatic image on an image bearing member into a toner image, with the use of developer which contains toner and carrier.

There have been widely used an image forming apparatus such as a copying machine, a printer, and a facsimile, the developing device of which develops an electrostatic image formed on an image bearing member such as a photosensitive drum, into a toner image, with the use of developer which contains toner and carrier.

Referring to FIG. 3, the background technologies of an image forming apparatus of the abovementioned type is described. A developing device (1) circularly moves developer through a development chamber (14) and a stirring chamber (15), which are in connection to each other through openings (7*a*, 7*b*), by rotating a conveyance screw (5) and a stirring screw (6). As the developer in the developing device (1) is continuously stirred for a substantial length of time, the developer in the developing device (1) deteriorates. Thus, as an image forming operation continues, the developer container (2) is continuously replenished with developer little by little, while causing the developer in the developer container (2) to overflow from the developer container (2) by the amount by which the amount of the developer in the developer container (2) was made excessive by the replenishment of the developer container (2) with carrier (Japanese Laid-open Patent Application 2010-256701).

In the case of the developing device (1) disclosed in Japanese Laid-open Patent Application 2010-256701, a return screw (10) which is opposite in the developer conveyance direction from the stirring screw (6) is disposed on the downstream side of the stirring chamber (15), in order to discharge the developer through a developer discharge opening (8) as the developer flows downstream of the stirring chamber (15) over the return screw 10.

In the case of the developing apparatus disclosed in Japanese Laid-open Patent Application 2010-237329, a disc-shaped member is provided on the upstream side of the return screw (10), in terms of the developer conveyance direction of the return screw (10), that is, the downstream side of the stirring chamber (15) in terms of the downstream side of the developer conveyance direction of the stirring chamber (15), to prevent the developer from flowing downstream of the stirring chamber (15) over the return screw (10) by an excessive amount.

It has been discovered that in the case of the developing apparatus (1) which uses the return screw (10) to regulate the discharging of the developer, the amount by which the developer is discharged changes in synchronism with the rotational period of the return screw (10), or the rotational period of the conveyance screw (5) which rotates in the development chamber (14) which is located next to the stirring chamber (15). It has also been discovered that as the stirring screw (6) is switched in rotational speed, and/or as developer changes in fluidity, the amount by which the developer is discharged changes.

SUMMARY OF THE INVENTION

The primary object of the present invention, which relates to a developing apparatus which uses a return screw to regulate the amount by which developer is discharged, is to provide a developing apparatus which is stable in the effects of the regulation, being therefore smaller in the change in the amount of developer discharge, and therefore, is stable in developer discharge.

According to an aspect of the present invention, there is provided a developing apparatus comprising a first chamber in which a developer including toner and carrier is fed; a second chamber in fluid communication with said first chamber to form a circulation path for the developer; a rotation shaft rotatable in said first chamber; a first blade member provided on said rotation shaft and configured to feed the developer in a predetermined direction in said first chamber; a second blade member provided on said rotation shaft and configured to feed the developer fed by said first blade member in a direction opposite the predetermined direction; a discharging portion provided downstream of said second blade member with respect to the predetermined direction and configured to discharge the developer in said first chamber; and a regulating member having a regulating surface continuously extending in a rotational moving direction of said rotation shaft and configured to regulate the developer fed by said first blade member, said regulating member being provided on said rotation shaft in a region between said first blade member and said second blade member, a region connecting with a downstream end of said first blade member, or a connecting with a downstream end of said second blade member.

Further features of the present invention will become apparent from the following description of exemplary embodiments (with reference to the attached drawings).

DESCRIPTION OF THE PREFERRED EMBODIMENTS

Hereinafter, preferable embodiments of the present invention are described in detail with reference to appended drawings.

(Image Forming Apparatus)

Figure 1:
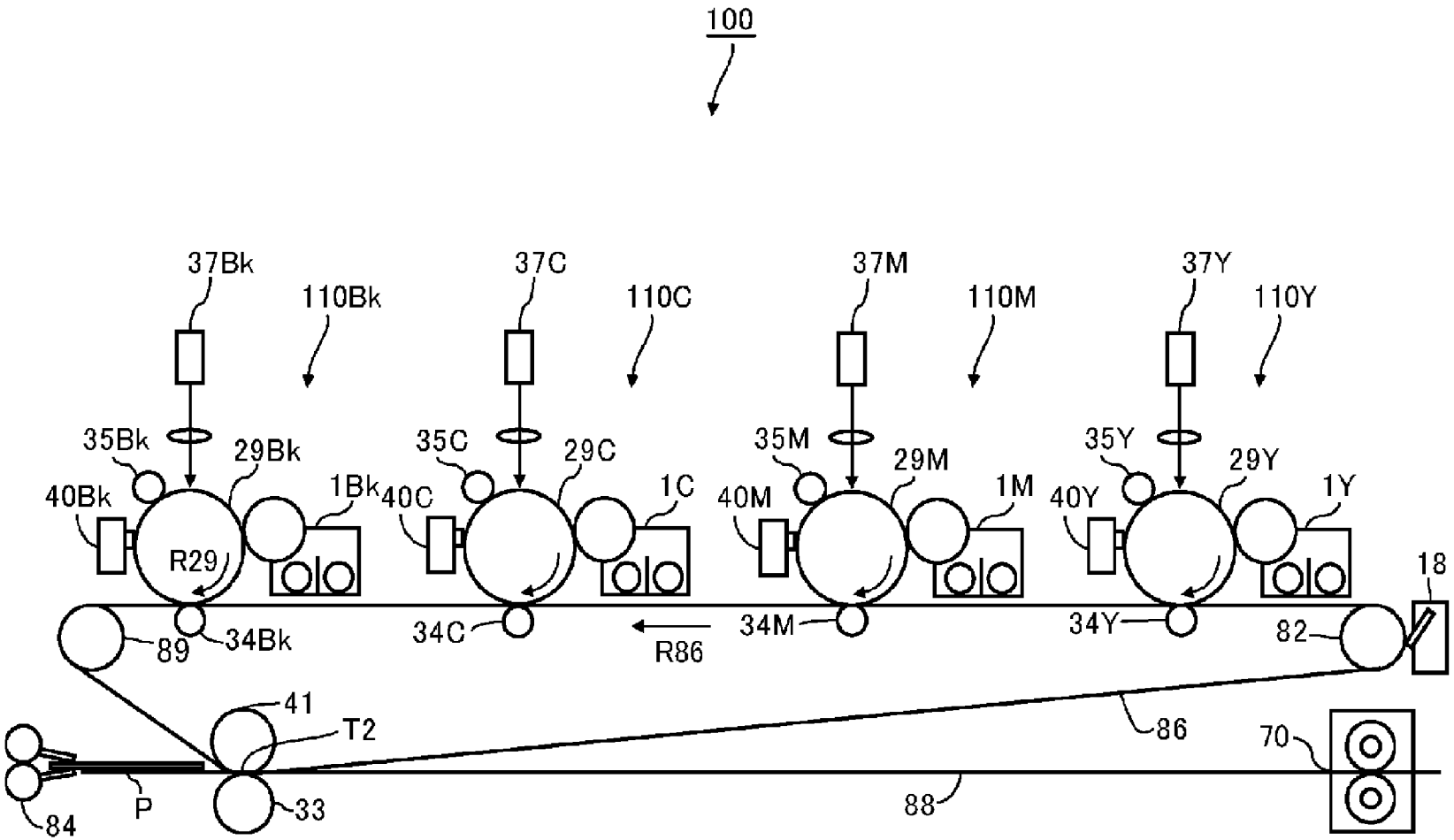
FIG. 1 is a drawing for describing the structure of the image forming apparatus in the first embodiment of the present invention.

FIG. 1 is a drawing for describing the structure of the image forming apparatus in the first embodiment. Here, the overall structure and operation of the image forming apparatus in the first embodiment are described.

Referring to FIG. 1, the image forming apparatus 100 is an electrophotographic full-color printer having four image formation sections, which correspond one for one to the four primary colors, more specifically, yellow, magenta, cyan and black.

The image forming apparatus 100 is capable of forming a full-color image (based on four primary color) on a sheet of recording medium (recording paper, plastic film, fabric, etc.), in response to image formation signals it receives from an image reading apparatus which is in connection to the main assembly of the apparatus 100, or a host apparatus, such as a personal computer, connected to the main assembly so that communication is possible between the image forming apparatus 100 and host apparatus.

The image formation sections 110Y, 110M, 110C and 110Bk form yellow, magenta, cyan, and black toner images, with the use of photosensitive drums 29Y, 29M, 29C and 29Bk, respectively. They place the four toner images in layers on an intermediary transfer belt 86.

Meanwhile a sheet P of recording medium stored in a recording medium storage cartridge (unshown) is conveyed to a secondary transfer section T2 with the use of a supply roller 84 and a conveyer belt 88, with the same timing as the timing with which the toner images are conveyed to the secondary transfer section T2. Then, the four toner images, different in color, on the intermediary transfer belt 86 are transferred together (secondary transfer) onto the sheet P of recording medium on the conveyer belt 88, by the application of transfer bias to a secondary transfer roller 33.

After the transfer of the toner images onto the sheet P of recording medium from the intermediary transfer belt 86, the sheet P is separated from the conveyer belt 88, and is conveyed to a fixing device 70, which thermally fixes the toner images to the sheet P by applying heat and pressure to the sheet P onto which the toner images were transferred. Thus, the toner images on the sheet P are melted and mixed, becoming a permanent full-color image. Thereafter, the sheet P is discharged from the image forming apparatus 100.

The toner which remained on the intermediary transfer belt 86 in the secondary transfer section T2 is removed by a belt cleaning apparatus 18. Not only can the image forming apparatus 100 form a full-color image, but also, a monochromatic image of a desired color, and a multicolor image having two or more colors, with the use of only the desired image formation section, or sections.

(Image Formation Section)

Referring to FIG. 1, the four image formation sections 110Y, 110M, 110C and 110Bk are practically the same in structure, although they are different in developer color. That is, in the first embodiment, the developing devices 1Y, 1M, 1C and 1Bk which correspond to yellow, magenta, cyan and black, respectively, are the same in structure. In the following description of the developing devices, therefore, suffixes Y, M, C and Bk which indicate which image formation section each structural component, and portions thereof, belong, are left out to describe the four image formation sections together.

Generally speaking, a photosensitive drum 29 (photosensitive member) which is an example of an image bearing member is an electrophotographic photosensitive member which is in the form of a rotatable drum. A charge roller 35 (charging process) uniformly charges the photosensitive drum 29 to preset polarity and potential level. An exposing device 37 (exposing process) is an information writing means which forms an electrostatic image on the charged photosensitive drum 29. A developing device 1 (developing process) develops the electrostatic image formed on the photosensitive drum 29, into a toner image, with the use of the toner in developer. A transferring device 34 (transferring process) transfers the toner image onto the intermediary transfer belt 86 from the peripheral surface of the photosensitive drum 29. A drum cleaning device 40 (cleaning process) moves a small amount of toner (residual developer, transfer residual toner) remaining on the photosensitive drum 29 after the transfer of the toner image from the photosensitive drum 29, to clean the peripheral surface of the photosensitive drum 29. The photosensitive drum 29 is repeatedly subjected to electrophotographic processes (charging process, exposing process, developing process, transferring process and cleaning process) to form toner images.

The photosensitive drum 29 is a cylindrical photosensitive component. It is rotationally driven in the direction indicated by an arrow mark R29 in the drawing. The charge roller 35, developing device 1, primary transfer roller 34, and drum cleaning device 40 are disposed in the adjacencies of the peripheral surface of the photosensitive drum 29. There is also disposed an exposing device 37 which employs a laser scanner disposed above the photosensitive drum 29.

The intermediary transfer belt 86 is disposed so that it is pinched by the photosensitive drum 29 and primary transfer roller 34. It is circularly driven by a driver roller 89 in the direction indicated by an arrow mark R86 to convey the toner images to the secondary transfer section T2 in which the toner images are transferred onto a sheet P of recording medium.

As an image forming operation begins, first, the peripheral surface of the rotating photosensitive drum 29 is uniformly charged by the charge roller 35. During this process of charging the photosensitive drum 29, charge bias is applied to the charge roller 35 from a charge bias power source. Next, the photosensitive drum 29 is exposed by a beam of laser light emitted by the exposing device 37 while being modulated with image formation signals. Consequently, an electrostatic image (latent image) is effected on the photosensitive drum 29.

The electrostatic image on the photosensitive drum 29 is developed into a visible image by the toner stored in the developing device 1. In the case of the developing device 1 in this embodiment, a reversal developing method is used. Thus, toner adheres to the points (areas) of the peripheral surface of the photosensitive drum 29, which have just been exposed to the beam of laser light. After the formation of a toner image on the photosensitive drum 29 by the developing device 1, the toner image is transferred onto the intermediary transfer belt 86 (primary transfer). The transfer residual toner, that is, the toner remaining on the photosensitive drum 29 after the primary transfer is removed by the drum cleaning device 40.

(Developing Device)

Figure 2:
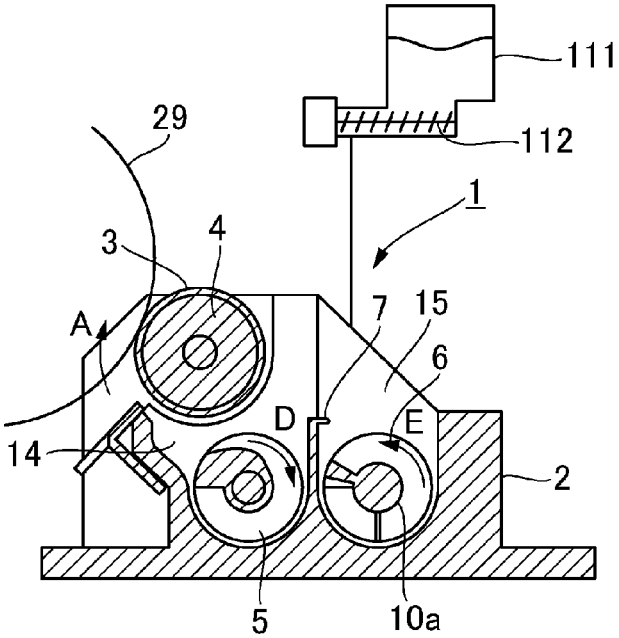
FIG. 2 is a sectional view of the developing apparatus, at a plane which is perpendicular to the axial lines of the rollers of the apparatus. It is a drawing for describing the structure of the apparatus.
Figure 3:
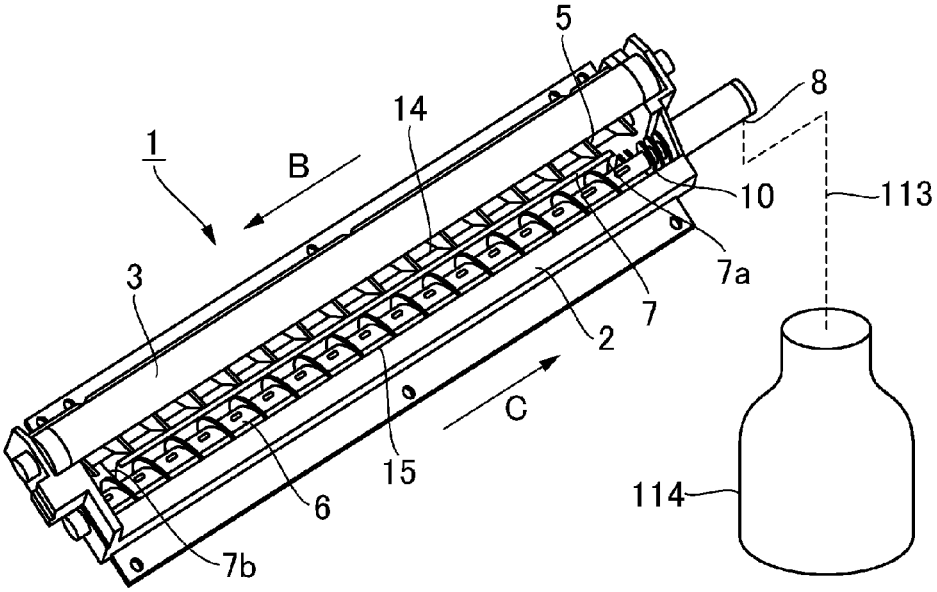
FIG. 3 is a perspective view of the developing apparatus.

FIG. 2 is a sectional view of the developing device 1, at a plane which is perpendicular to the axial lines of the rollers of the developing device 1. It is for describing the developing device 1. FIG. 3 is a perspective view of the developing device 1. The developing device 1 uses a two-component developing method, which uses a mixture of toner and carrier, as its developer. A two-component developing method is advantageous in terms of the image quality stability, apparatus durability, etc., over other developing methods which are presently proposed.

Referring to FIG. 2, the developing device 1 stores two-component developer made up of toner (nonmagnetic) and carrier (magnetic), in its developer container 2. The ratio of mixture between the toner and carrier is roughly 1:9 in weight. This ratio is to be properly adjusted according to the amount of toner charge, carrier particle diameter, structure of the image forming apparatus 100, etc. The ratio should not be limited to the abovementioned numerical value.

The developing device 1 has an opening, which corresponds in position to the development area of the developing device 1, which faces the photosensitive drum 29. It has also a development sleeve 3 and a magnet 4. The development sleeve 3 is disposed so that it is partially exposed from the developer container 2 through the opening. The magnet 4 is disposed in the hollow of the development sleeve 3.

The development sleeve 3 is formed of a nonmagnetic substance. During a developing operation, it is rotated in the direction indicated by an arrow mark A. It holds in a layer the two-component developer in the developer container 2, and conveys the layer of developer to the development area, in which it supplies the photosensitive drum 29 with the developer to develop the electrostatic image on the photosensitive drum 29. After the development of the electrostatic image, the developer is recovered into the developer container 2 by the rotation of the development sleeve 3.

Next, referring to FIG. 3, the interior of the developer container 2 has a development chamber 14 which is the second chamber in which the development sleeve 3 and developer are storable, and a stirring chamber 15 which is the first chamber in which the developer is storable. The two chambers 14 and 15 are divided by a partition wall 7. There are disposed a conveyance screw 5 and a stirring screw 6 in the development chamber 14 and stirring chamber 15, respectively. The developer in the developer container 2 is circularly conveyed in the developer container 2 by the conveyance screw 5 and stirring screw 6 while being stirred and mixed by the conveyance screw 5 and stirring screw 6.

The above-mentioned partition wall 7 is between the conveyance screw 5 and stirring screw 6. The rear portion of the partition wall 7 is provided with an opening 7*a*, whereas the front portion of the partition wall 7 is provided with an opening 7*b*, in order to ensure that while the developer is circularly conveyed in the developer container 2, the developer is allowed to smoothly move between the development chamber 14 and stirring chamber 15. The openings 7*a* and 7*b* connect the development chamber 14 and stirring chamber 15, making up parts of the developer circulation passage.

The developer in the development chamber 14 is conveyed in the direction indicated by an arrow mark B, whereas the developer in the stirring chamber 15 is conveyed in the direction indicated by an arrow mark C. That is, the developer is circularly moved in the developer container 2 by being conveyed in the direction indicated by the arrow mark B, and then, in the direction indicated by the arrow mark C.

(Automatic Developer Replacement Method)

Figure 4:
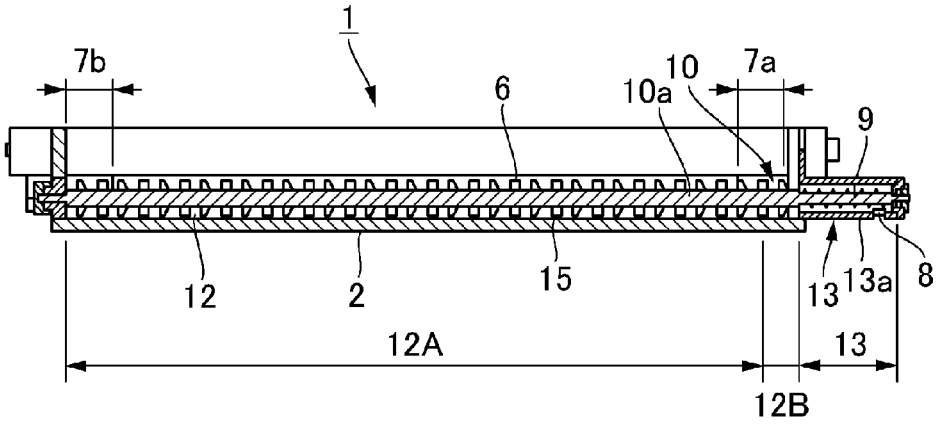
FIG. 4 is a sectional view of the stirring chamber at a plane which is perpendicular to the lengthwise direction of the chamber. It is for describing the stirring chamber.
Figure 5:
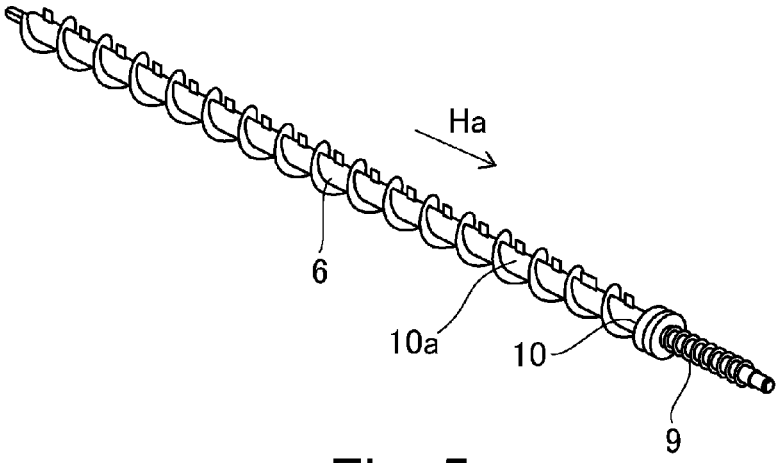
FIG. 5 is a perspective view of the stirring screw.

FIG. 4 is a sectional view of the stirring chamber 15, at a vertical plane parallel to the lengthwise direction. It is for describing the stirring chamber 15. FIG. 5 is a perspective view of the stirring screw 6.

In the case of the developing device 1 which uses a two-component developing method, it is impossible for the developing device 1 to escape from the developer deterioration, in particular, carrier deterioration, which is attributable to the continuous and extended usage of the device 1. Thus, a method for automatically replacing developer is employed. An automatic developer replacement method replenishes the developing device 1 with replenishment developer which contains toner, by the amount by which toner was consumed by the developing operation of the developing device 1. It discharges the excessive amount of developer in the developing device 1, into an external recovery container 114. As the replenishment developer, such developer that contains carrier by a preset ratio (roughly 10% in weight) is used.

Also in the case of an automatic developer replacement method, the excessive amount of developer in the developing device 1 is automatically discharged at roughly the same time as the replenishment of the developing device 1 with replenishment toner. The usage of this method, therefore, makes it possible to keep stable the developer in the developing device 1 in overall properties, without requiring an image forming apparatus to be increased in size and/or cost. Further, the developer replacement operation is automatically carried out as an image forming operation continues. Thus, this method makes unnecessary an operation for entirely replacing the developer in the developing device 1, or replacing the developing device 1 itself. Thus, this method makes it possible to improve a developing device in terms of maintenance, and also, to reduce a developing device in operational cost.

Referring to FIG. 2, a developer replenishment section 11 delivers replenishment developer to the upstream side of the stirring screw 6, in terms of the developer conveyance direction of the stirring screw 6, in the stirring chamber 15. As a replenishment screw 112 is rotated, such developer that contains toner by the amount by which toner was consumed by image formation is delivered to the developer container 2.

The toner in developer is consumed by image formation. However, the carrier delivered to the developing device 1 is not consumed by image formation. Thus, it remains in the developer container 2. Therefore, as the developer container 2 is continuously replenished with replenishment developer to keep stable, in toner density, the developer in the developer container 2, the developer in the developer container 2 gradually increases, as an image forming operation continues.

Next, referring to FIG. 4, there is provided a developer discharge passage 13 on the downstream side of the stirring screw 6 in terms of the developer conveyance direction. The discharge passage 13 extends from the developer conveyance passage 12 (part of developer circulation passage) in which the stirring screw 6 is disposed. The developing device 1 is designed so that the bottom surface 13*a* of the discharge passage 13 is positioned higher than the bottom surface 12*a* of the conveyance passage 12. Further, the bottom surface 13*a* of the discharge passage 13 is provided with a developer discharge opening 8. The rotational shaft 10*a* of the stirring screw 6 is rotatably disposed, extending through the conveyance passage 12 and discharge passage 13. It rotates the return screw 10 and developer discharge screw 9 together.

Referring to FIG. 5, the return screw 10 is disposed on the downstream side of the stirring screw 6 in terms of the conveyance direction of the stirring screw 6. The developer conveyance direction of the return screw 10 is opposite from the developer conveyance direction Ha of the stirring screw 6. The developer discharge screw 9 is disposed on the downstream side of the return screw 10 in terms of the developer conveyance direction of the stirring screw 6. The developer conveyance direction of the developer discharge screw 9 is the same as the developer conveyance direction Ha of the stirring screw 6.

Referring to FIG. 4, the developer discharge screw 9 conveys the excessive amount of developer in the discharge passage 13 to the developer discharge opening 8, and discharges the developer through the opening 8. As the developer in the developer container 2 is increased by the repetition of the replenishment of the developing device 1 with the replenishment developer, the developer in the stirring chamber 15 starts to flow into the discharge passage 13 over the return screw 10, and be conveyed to the developer discharge opening 8, and discharged from the opening 8, by the developer discharge screw 9. As the developer is discharged through the developer discharge opening 8, it is recovered by the recovery container (114 in FIG. 3), and is stored therein.

As described above, in the case of an automatic developer replacement method, the developing device 1 is automatically and gradually replenished with replenishment developer in such a manner that the developer container 2 remains stable in the amount of the developer therein. That is, the developing device 1 is replenished with toner by the amount by which toner was consumed by an image forming operation, by the replenishment of the developing device 1 with the replenishment developer, while discharging the developer in the developer container 2, which has become excessive in carrier content.

(Comparative Developing Device)

Figure 6:
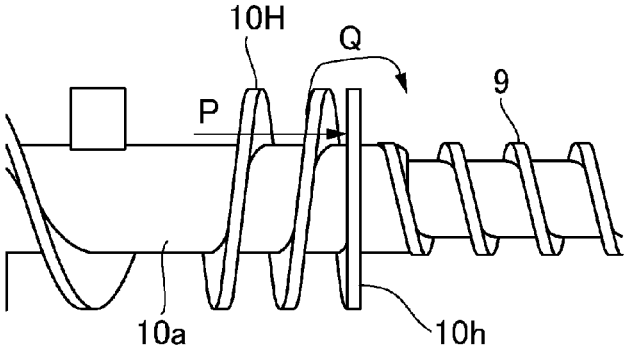
FIG. 6 is an enlarged view of a comparative return screw.
Figure 7:
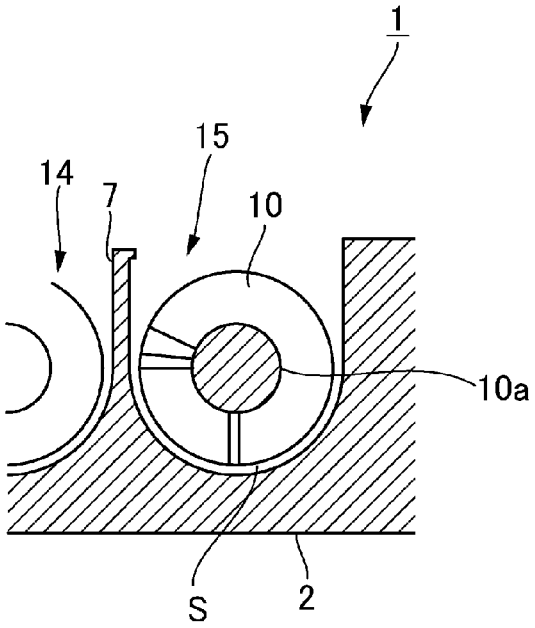
FIG. 7 is a drawing for describing the gap between the peripheral edge of the return screw and the inward surface of the stirring chamber.
Figure 8:
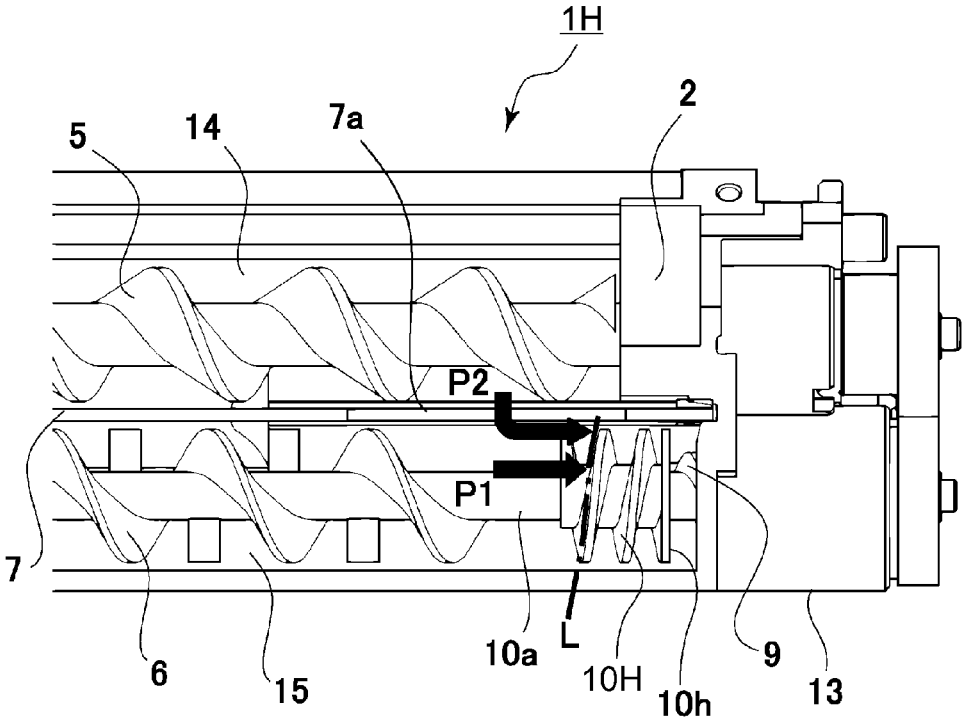
FIG. 8 is a plan view of the adjacencies of the return screw of the comparative developing apparatus.

FIG. 6 is an enlarged view of the return screw 10H of the comparative developing device 1. FIG. 7 is a drawing for describing the gap between the peripheral edge of the return screw 10H and inward surface of the stirring chamber 15. FIG. 8 is a plan view of the adjacencies of the return screw 10H of the comparative developing device 1. By the way, in FIGS. 8 and 9, the portion of the developer container 2, which covers the top side of the developer container 2, is not illustrated, in order to show the internal structure of the developing device 1.

Referring to FIG. 6, across the downstream end portion of the stirring screw 6 in terms of the developer conveyance direction, the developer is conveyed in the direction indicated by an arrow mark P. A certain amount of developer flows over the return screw 10H as indicated by an arrow mark Q. Then, it is conveyed to the developer discharge opening 8 in FIG. 4) by the discharge screw 9, and is discharged through the developer discharge opening 8.

If the most upstream end of the blade of the return screw 10H in terms of the developer conveyance direction of the return screw 10H has a break as disclosed in Japanese Laid-open Patent Application 2010-237329, the developer periodically moves through the break. Thus, the developing device 1 is likely to become unstable in developer discharge. Thus, in the case of the return screw 10H of the comparative developing device, the most upstream end of the return screw 10H is provided with a regulatory portion 10*h*, which is a disc-shaped developer damming plate, in order to eliminate the break to prevent the developer from being discharged through the blade break.

Referring to FIG. 7, in order to prevent the return screw 10 and developer container 2 from contacting each other, a small amount (roughly 2.0 mm) of gap, which is arc-shaped in cross-section (FIG. 7), is provided between the peripheral edge of the return screw 10H and inward surface of the developer container 2. Across the downstream end portion of the return screw 10H in terms of the conveyance direction in the stirring chamber 15, the developer is present across both the upstream and downstream portions of the return screw 10H. Therefore, the developer in the arc-shaped gap S will have lost its fluidity by being compressed. Thus, it is rare that the developer in the arc-shaped gap S leaks into the discharge passage (13 in FIG. 4) and then, is discharged.

However, on the upstream side of the return screw 10H in terms of conveyance direction, there is no developer. Thus, if the blade has a break on the upstream side of the return screw 10H in terms of the conveyance direction, no regulatory portion on the upstream side of the return screw 10H, the developer is not pressed, and therefore, it becomes fluid again, being therefore likely to leak into the discharge passage (13 in FIG. 4).

In the case of the comparative developing device, a disc-shaped regulatory portion 10*h* is provided at the upstream end of the return screw 10H in terms of the conveyance direction, in order to prevent the blade from having a break, in order to prevent the problem that the developer simply goes through the arc-shaped gap S, and is discharged through the developer discharge opening 8.

Referring to FIG. 8, in the case of the comparative developing device 1H, the developer in the developer container 2 is circularly conveyed through the development chamber 14 and stirring chamber 15 by the rotation of the conveyance screw 5 and stirring screw 6. While the developer is conveyed by the stirring screw 6, it is not stable in speed. That is, it turns into a developer flow indicated by an arrow mark P1, which periodically changes in speed in synchronism with the rotational phase of the blade of the stirring screw 6. Then, as a certain amount of developer flows over the return screw 10H, and leaks to the discharge passage 13. The surface of this flow of developer tends to be made to periodically rise like waves, by the developer flow indicated by the arrow mark P1, which periodically changes in speed.

Further, as the developer is delivered from the stirring chamber 15 into the development chamber 14 through the opening 7*a*, a part of the developer is pushed back into the stirring chamber 15 through the opening 7*a* as the blade of the conveyance screw 5 is rotated. That is, it flows in the direction indicated by an arrow mark P2. The developer flow in the direction indicated by the arrow mark P2 periodically changes in speed in synchronism with the rotational phase of the conveyance screw 5. Thus, the developer flows over the return screw 10H and leaks into the discharge passage 13, with the same timing as that with which the developer flow indicated by the arrow mark P2 periodically changes in speed, and therefore, flows in the manner of succession of waves, that is, the same timing as that with which the developer surfaces rises.

Also in the developing device 1H, the developer flow indicated by the arrow marks P1 and P2, which periodically changes in speed like succession of waves collide with the developer which is being conveyed by the return screw 10H, at the developer return line L which the blade of the return screw 10H forms. Therefore, the developer return line L substantially changes in position in terms of the developer conveyance direction in response to the rotational phase of the downstream end of the blade of the return screw 10H. The range in which the position of the developer return line L changes is as large as a single pitch of the spiral blade of the return screw 10H.

Figure 9:
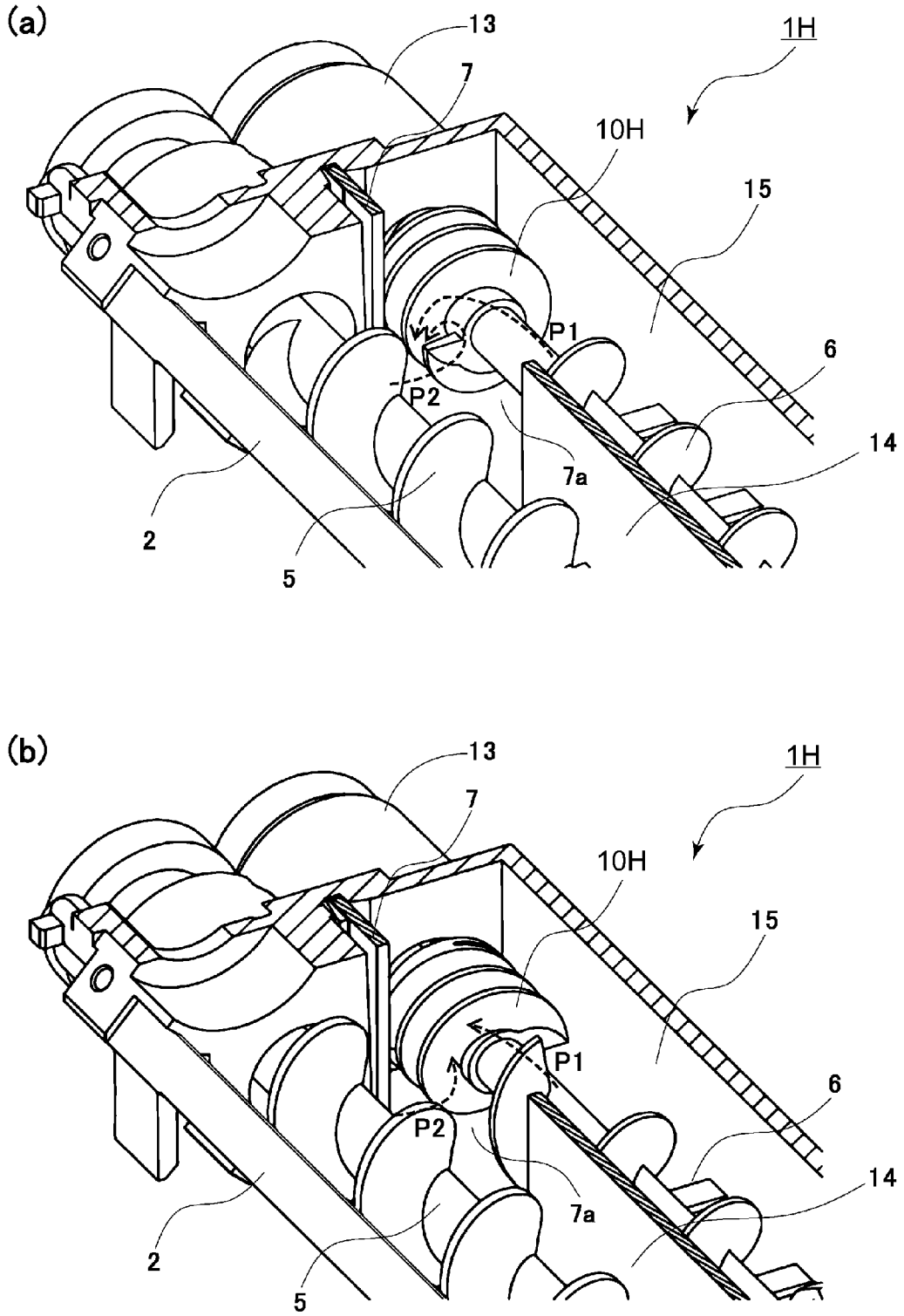
FIG. 9 is perspective view of the adjacencies of the return screw of the comparative developing apparatus.

Referring to FIG. 9(*a*), therefore, as the developer return line L retracts, the collision between the developer and the blade of the return screw 10H is delayed, and also, the developer flow indicated by the arrow marks P1 and P2 slips by the return screw 10H through the break of the blade of the return screw 10H, which is at the end surface of the return screw 10H. As the surface of the developer flow indicated by the arrow marks P1 and P2 which flows into the return screw 10H rises with the latest timing with which the blade of the return screw 10H pushed back the developer flow indicated by the arrow marks P1 and P2, the developer suddenly leaks into the discharge passage (13 in FIG. 4). Further, the higher the conveyance screw 5 and stirring screw 6 in rotational speed, the greater the pulsation of the developer flow indicated by the arrow marks P1 and P2, and the changes in the height of the developer flow surface. Therefore, the higher the operational speed of the developing device 1H, the more conspicuous the periodic leakages of the developer.

By the way, the developer flow indicated by the arrow marks P1 and P2 changes in height (surface height). Further, the blade of the return screw 10H periodically changes in its ability to prevent, by its blade, the developer flow indicated by the arrow marks P1 and P2 from leaking out. Therefore, it is reasonable to think that the relationship in terms of rotational phase among the discharge screw 9, stirring screw 6, and return screw 10H should be optimized according to the change in the height of the surface of the developer flow indicated by the arrow marks P1 and P2. That is, in order to optimize the above described relationship in rotational phase, the timing with which the developer surface of the developer flow indicated by the arrow marks P1 and P2 becomes highest should be offset by 180° in rotational phase so that the developer return line L which the blade of the return screw 10H forms becomes farthest from the discharge passage (13 in FIG. 4) when the developer surface becomes highest.

Referring to FIG. 9(*b*), in terms of the rotational phase of the return screw 10H, the developing device 1H is designed so that the return screw 10H pushes back each wave of developer flow by its most downstream end portion, in synchronism with the timing with which each wave of developer flow arrives at the most downstream end portion of the return screw 10H. With the developing device 1H being designed as described above, it is possible to prevent the problem that the force which pushes back the developer flow reduces in strength, and also, the problem that developer slips by the return screw 10H through the blade break which is at the end surface of the return screw 10H. This design is theoretically possible in a case where the developing device 1H is always driven at a preset rotational speed.

However, in the case of a developing device which is to be mounted in an image forming apparatus which can be operated in one of multiple preset speeds, that is, an image forming apparatus switchable in operational speed, it has to be operatable in various speeds. Therefore, it cannot be designed as described above, because it is difficult to design a developing device so that the point in time at which the pulsation of the developer flow, which is caused by the stirring screw 6 and/or conveyance screw 5, arrives at the most downstream end portion of the return screw 10, synchronize with the rotational phase of the most downstream end portion of the blade of the return screw 10H, regardless of the operational speed of the developing device 1H (rotational speed of return screw 10H), because as the developing device 1H is switched in operational speed, the developer which flows to the return screw 10H, changes in the timing with which its surface rises.

In the following embodiments of the present invention, therefore, a structure for damming up the developer as the developer flows to the return screw 10 from the upstream side of the stirring chamber 15 is disposed on the downstream side of the return screw 10 in terms of the conveyance direction, in order to enable the developing device 1 to properly push back the developer at the same position, regardless of the rotational phase of the return screw 10.

Characteristic Portions of Developing Device in Embodiment 1

Figure 10:
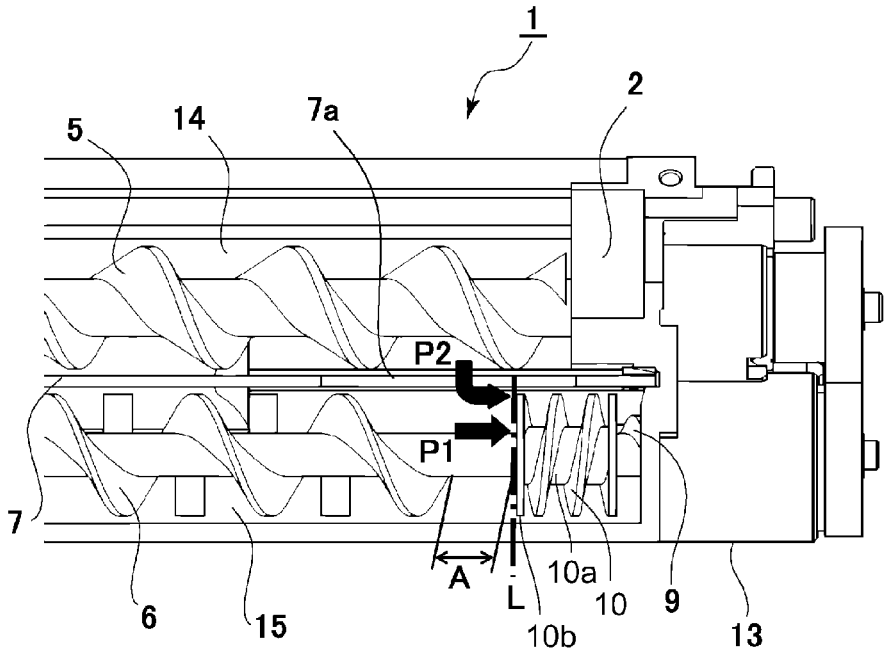
FIG. 10 is a plan view of the adjacencies of the return screw of the developing apparatus in the first embodiment.
Figure 11:
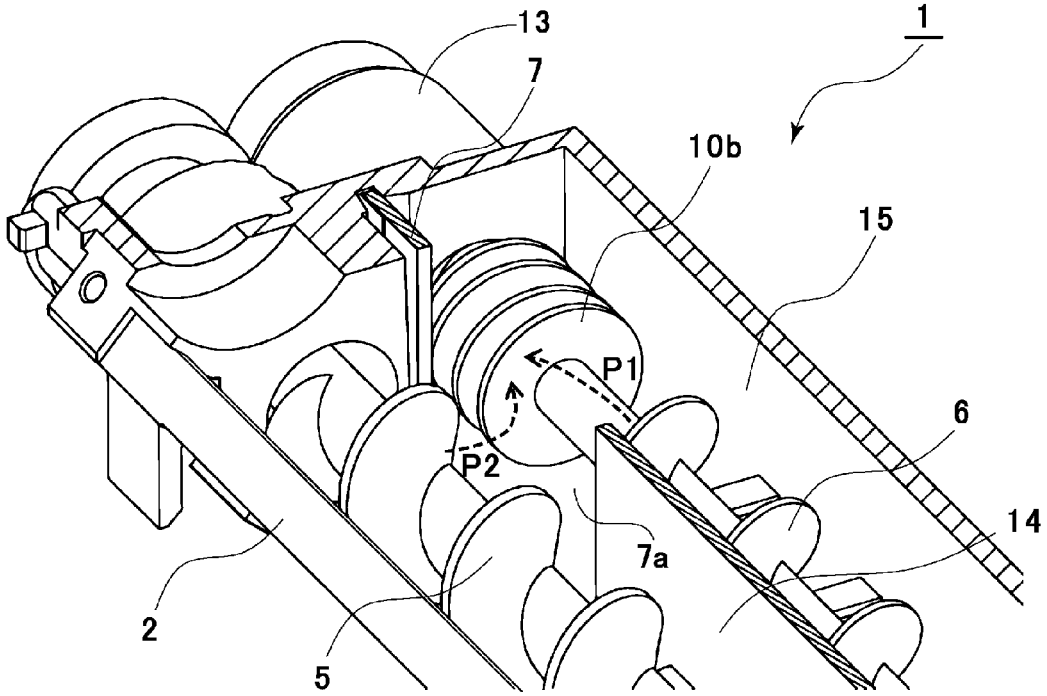
FIG. 11 is a perspective view of the adjacencies of the return screw of the developing apparatus in the first embodiment.
Figure 12:
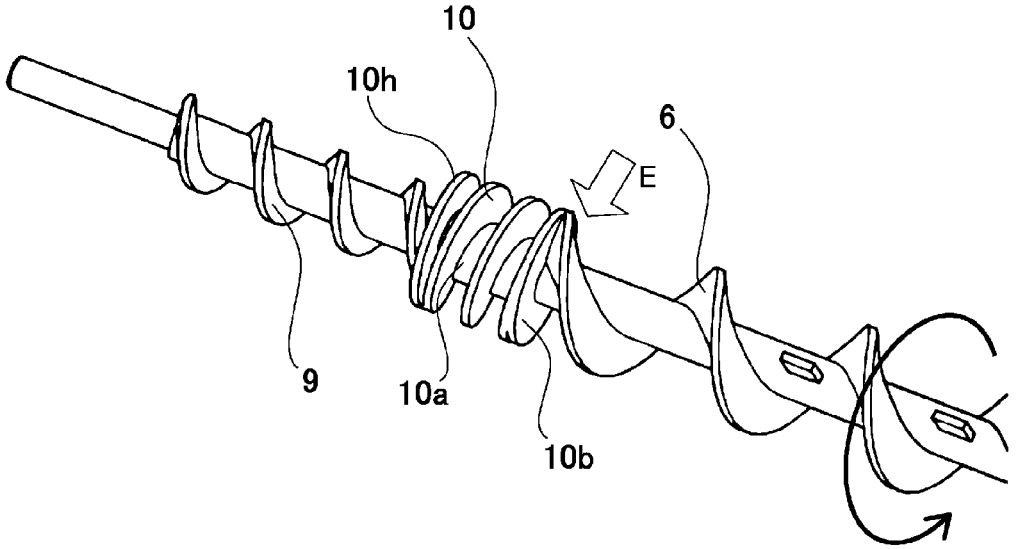
FIG. 12 is a perspective view of the adjacencies of the return screw of a developing apparatus which has no blade-free portion between its regulatory portion and stirring screw.

FIG. 10 is a plan view of the adjacencies of the return screw 10 of the developing device 1 in the first embodiment. FIG. 11 is a perspective view of the adjacencies of the return screw 10 of the developing device 1 in the first embodiment. FIG. 12 is a drawing for describing a developing device, which has an area which has no blade between the regulatory portion and stirring screw 6. By the way, in FIGS. 10 and 11 which show the internal structure of the developing device 1, the portion of the developing device 1, which covers the top side of the developer container 2, is not illustrated.

Referring to FIG. 10, the stirring chamber 15 which is an example of the first chamber, and the development chamber 14 which is an example of the second chamber, are in connection to each other through the opening 7*a*, making up a passage through which the developer circulates. The stirring screw 6 which is an example of the first member with a blade conveys the developer in a preset direction, whereas the return screw 10 which is an example of the second member with a blade conveys the developer in the opposite direction from the preset developer conveyance direction of the stirring screw 6, as the developer is conveyed to the return screw 10 by the stirring screw 6. The discharge passage 13 which is an example of a passage for discharging the developer is disposed on downstream side of the return screw 10 in terms of the preset developer conveyance direction of the stirring screw 6 to discharge the developer in the stirring chamber 15.

The regulatory portion 10*b* which is an example of regulatory component is disposed between the stirring screw 6 and return screw 10. It has a regulatory surface which has no break in terms of the rotational direction of the regulatory portion 10*b*. It regulates the developer as the developer conveyed by the stirring screw 6 flows to the return screw 10. The regulatory portion 10*b* is shaped so that it has no break in terms of its rotational direction. The regulatory surface of the regulatory portion 10*b* is round and flat. The regulatory portion 10*b* is connected to the downstream end of the return screw 10 in terms of the conveyance direction. It is in the form of a disc, and is the same in external diameter as the return screw 10. By the way, the regulatory portion 10*b* may be connected to the downstream end of the stirring screw 6, or the downstream end of the return screw 10.

The regulatory portion 10*b* which is in the form of a disc and is continuous in terms of its circumferential direction is disposed at the downstream end of the blade of the return screw 10. It is connected to the downstream end of the blade. The surface of the regulatory portion 10*b*, which faces the developer flow indicated by the arrow marks P1 and P2, is flat. Thus, the end surface of the return screw 10, that is, the first surface with which the developer flow generated in the direction (downstream direction) indicated by the arrow mark P1 in the stirring chamber 15 by the stirring screw 6 collides is the flat surface which is in the form of a disc. Further, the end surface of the blade of the return screw 10, that is, the first surface with which the reversal developer flows, indicated by the arrow mark P2, which flows back into the stirring chamber 15 from the development chamber 14 through the opening 7*a*, is also a flat surface and in the form of a disc. Therefore, the regulatory portion 10*b* can always push back the developer at the same position in terms of the conveyance direction of the return screw 10, regardless of the rotational speed of the screw and developer conveyance speed, as the developer begins to flow to the return screw 10.

Further, the regulatory portion 10*b* is greater in external diameter than the rotational shaft 10*a* of the return screw 10.

Therefore, it can prevent the developer flow indicated by the arrow mark P1 from periodically flowing to the return screw 10 through the break which the blade has in terms of its circumferential direction.

Further, in terms of the direction parallel to the rotational axis of the return screw 10 or stirring screw 6, the regulatory portion 10*b* is disposed away from the downstream end of the stirring screw 6 in terms of the conveyance direction. There is an area A in which only the rotational shaft 10*a* is present, between the flat surface of the regulatory portion 10*b* and the blade of the stirring screw 6. Therefore, the oscillatory changes in the height of the surface of the developer layer in the developer container 2, which is caused by the rotational of the stirring screw 6, attenuates in the area A. That is, the developer layer arrives at the return screw 10 after it is reduced in the oscillatory changes in the height of its top surface. Further, referring to FIG. 12, a phenomenon that a triangular space, which is formed by the blade and regulatory portion in a case where the blade of the stirring screw 6 is in connection to the regulatory portion 10*b* as indicated by an arrow mark E, enables the developer to flow over the regulatory portion 10*b* by scooping up the developer, does not occur. Therefore, the developer flow is prevented from pulsatively flowing, and/or changing in the height of its top surface, and therefore, the amount by which the developer periodically flows to the return screw 10 reduces.

Further, in terms of a preset direction, the regulatory portion 10*b* is disposed so that it overlaps with the opening 7*a* which is on the downstream side of the stirring screw 6 in terms of the conveyance direction of the stirring screw 6. Therefore, the rising of the surface of the developer flow, which is caused by the collision of the developer flow indicated by the arrow mark P1 with the regulatory portion 10*b*, can be utilized to efficiently deliver the developer from the stirring chamber 15 to the development chamber 14. Further, the rising of the surface of the developer flow, which is caused by the collision of the developer flow indicated by the arrow mark P1 can be utilized to push back the reversal developer flow, indicated by the arrow mark P2, from the stirring chamber 15 into the development chamber 14, in order to reduce the reverse developer flow.

By the way, the return screw 10 is provided with a regulatory portion 10*h* like the return screw 10H of the comparative developing device 1H. The regulatory portion 10*h* also is in the form of a disc, and is disposed at the upstream end of the blade of the return screw 10 in terms of the conveyance direction. As described above, this structural arrangement is for preventing the amount by which the developer leaks toward the discharge passage (13 in FIG. 4) from the return screw 10, from changing, regardless of the rotational phase of the return screw 10.

As described above, in the case of the developing device 1 in the first embodiment, its regulatory portion 10*b* reliably pushes back the developer, regardless of the rotational phase of the return screw 10. Therefore, it can prevent the developer from being discharged by an excessive amount, regardless of the rotational speed of the developing device 1 which can be driven at one of the multiple rotational speeds with which the developing device 1 is provided. Since it can prevent the developer from being discharged by an excessive amount, it can minimize the changes in the amount of the developer in the developer container 2, being therefore capable of always keeping the amount of the developer in the developer container 2 at a proper value.

Effects of Embodiment 1

In recent years, carrier has been improved in terms of its deterioration attributable to the operation of the developing device 1, and also, has been reduced in the amount of toner required for image formation. With the presence of such background, it is desired to reduce the amount by which developer is recovered and stored in the recovery container (114 in FIG. 3), by reduction in the amount by which carrier is supplied to the developing device 1, in order to reduce the image forming apparatus 100 in operational cost, and also, the amount of waste. However, as the amount by which carrier is supplied to a developing device (1) is reduced, the changes in the amount of the developer in the developer container (2), which is attributable to the periodic developer leakage, increases. In comparison, in the case of the developing device 1 in the first embodiment, the periodic developer leakage attributable to the rotation of the return screw 10 is unlikely to occur. Therefore, it is unlikely to occur that as the developing device 1 is driven, the amount of the developer in the developer container 2 falls below a preset minimum value, due to the excessive amount of developer discharge. Therefore, the developing device 1 in this embodiment is unlikely to suffer from the nonuniformity in image density, which is attributable to the unsatisfactory coating of the development sleeve 3 with the developer, which occurs as the amount of the developer in the developer container 2 falls below the minimum value.

Also in recent years, a developing device has been reduced in size, being therefore likely to be reduced in the amount by which its developer container is to be filled with developer. As the amount by which the developer container is to be filled is reduced, the change in the amount of the developer container, which is attributable to the periodic developer leakage, also increases. In comparison, in the case of the developing device 1 in this embodiment, the amount of the developer in the developer container 2 can be stabilized by the prevention of the periodic developer leakage. That is, the present invention can realize a developing device which is light, and small in the amount by which its developer container is to be filled with developer.

In the first embodiment, the regulatory portion 10*b* pushes back the developer flow in a proper manner, on the downstream side of the return screw 10, to prevent the developer from invading into the upstream side of the return screw 10. Therefore, it is unlikely for the developer to suddenly leak by an excessive amount. Thus, it is unlikely for the amount of the developer in the developer container 2 to reduce enough for it to fall below the minimum value.

In the first embodiment, on the downstream side of the return screw 10 in terms of the conveyance direction, the positional relationship between the developer having reversely flowed from the stirring screw 6 and development chamber 14 through the opening 7*a*, and the regulatory portion 10*b* which is the first object with which the developer collides, is not affected by the rotational phase of the stirring screw 6. Therefore, it is unlikely for the developer to flow to the return screw 10 through the blade break which is at the end surface of the return screw 10.

In the first embodiment, even if there occurs such a developer flow that the developer delivered from the stirring chamber 15 to the development chamber 14 through the opening 7*a* is partially made by the rotation of the conveyance screw 5 to flow back from the development chamber 14 to the stirring chamber 15, it can be dammed up by the regulatory portion 10*b*. Therefore, the reverse flow can be dealt with without designing a developing device so that the timing with which the developer wave arrives at the most downstream portion of the return screw 10 synchronizes with the rotational phase of the blade of the return screw 10. With the provision of the regulatory portion 10*b*, the periodic changes in the amount by which the developer flows to the return screw 10 reduces, regardless of the rotational speed of the developing device even if the developing device 1 has multiple rotational speeds. With the provision of the regulatory portion 10*b*, the return screw 10 can be designed with no attention to the length of time for the developer flow pulsation caused by the blade of the stirring screw 6 and/or conveyance screw 5 to reach the most downstream portion of the return screw 10.

The developing device 1 which uses a developer replacement method and has multiple developer conveyance speeds is prevented from excessively discharging the developer, and therefore, is capable of keeping the developer in the developer container 2 proper in amount, regardless of the developer conveyance speed. Even in the case of the steering roller 6 which is high in rotational speed, and therefore, tends to cause the developer to move in a pulsative manner, and increase the changes in the height of the developer surface, it is possible to prevent the developing device 1 from excessively discharging developer. Therefore, it is capable of keeping the developer in the developer container 2 always proper in amount.

Embodiment 2

Figure 13:
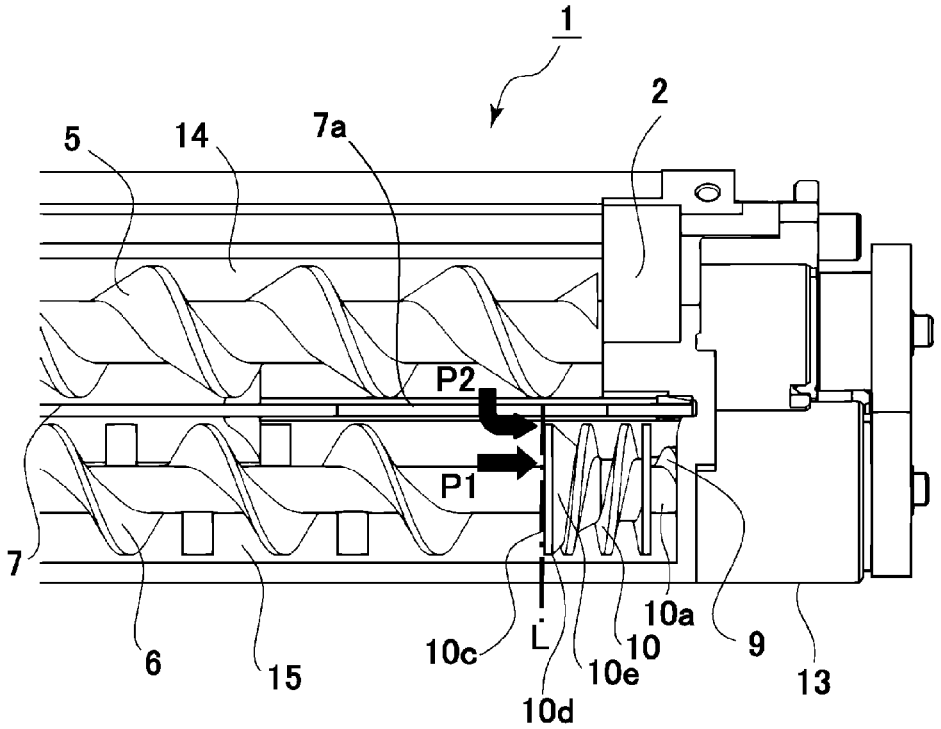
FIG. 13 is a plan view of the adjacencies of the return screw of the developing apparatus in the second embodiment.
Figure 14:
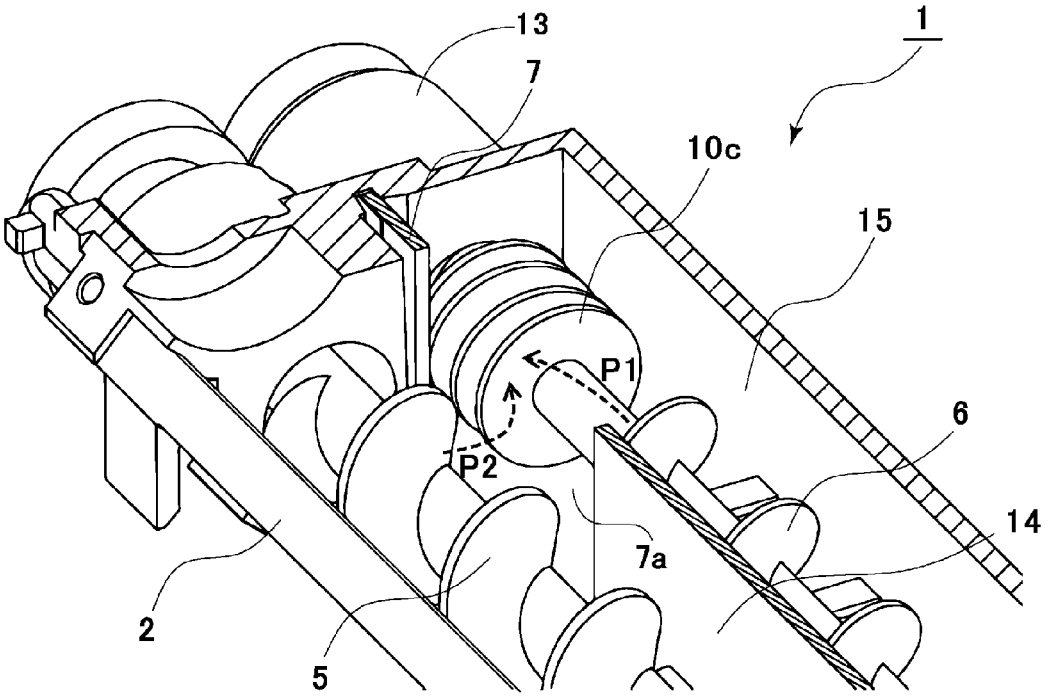
FIG. 14 is a perspective view of the adjacencies of the return screw of the developing apparatus in the second embodiment.
Figure 15:
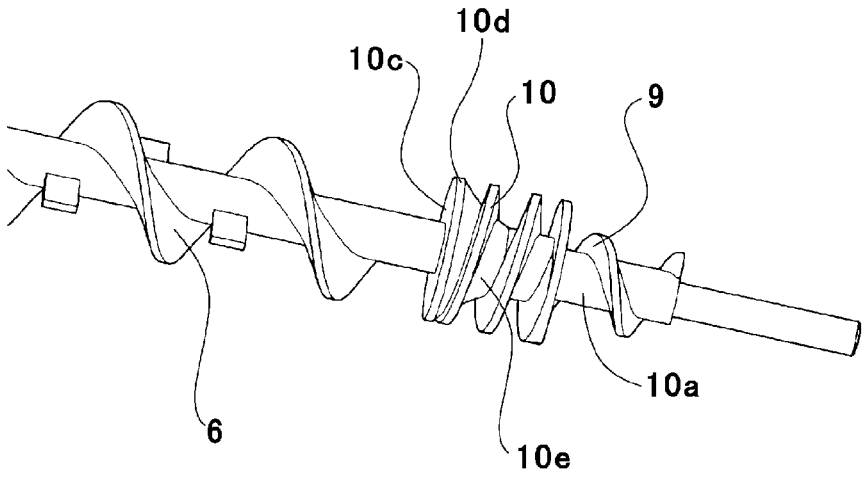
FIG. 15 is a drawing for describing a return screw having a tapered portion.
Figure 15:
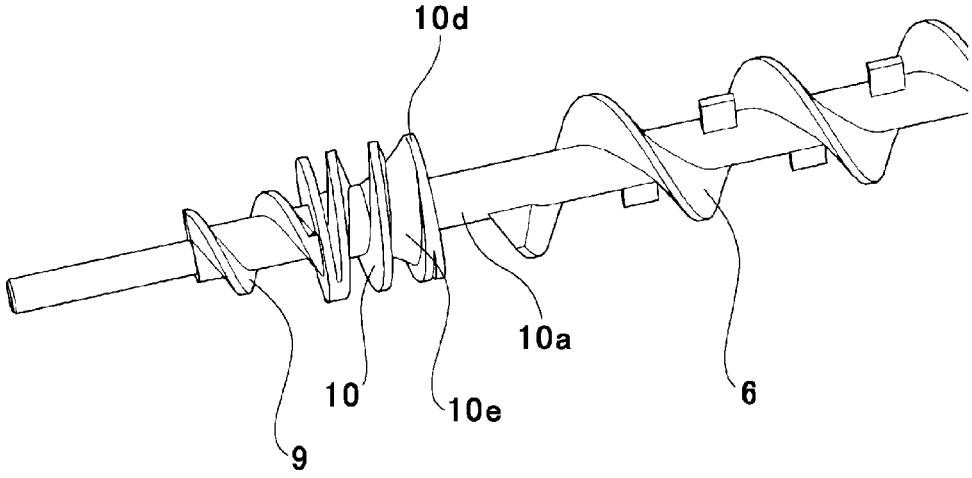

FIG. 13 is a plan view of the adjacencies of the return screw of the developing device in the second embodiment of the present invention. FIG. 14 is a perspective view of the adjacencies of the return screw of the developing device in the second embodiment. FIG. 15 is a drawing for describing a return screw provided with a tapered portion. The developing device in the second embodiment is the same in structure as the developing device 1 in the first embodiment, except that its return screw 10 is provided with a tapered portion. Therefore, the structural components, and portions thereof, of the developing device 1 shown in FIGS. 13-15, which are the same in structure as the counterparts shown in FIGS. 9 and 10, are given the same referential codes as those given to the counterparts, and are not described here in order not to repeat the same descriptions.

Referring to FIG. 13, in the second embodiment, the return screw 10 is provided with a regulatory portion 10*d*, which is located on the downstream end of the return screw 10 in terms of the conveyance direction. The downstream portion of the rotational shaft 10*a* of the regulatory portion 10*d* is greater in diameter than the upstream end of the rotational shaft 10*a* of the regulatory portion 10*d*. More specifically, the external diameter of the rotational shaft 10*a* of the return screw 10*d* is largest at the downstream end of the rotational shaft 10*a* in terms of the developer conveyance direction of the return screw 10, and gradually reduces toward the upstream end. The portion of the rotational shaft 10*a*, across which its diameter gradually reduces toward the upstream end in terms of the conveyance direction, overlaps with at least a part of the return screw 10.

Referring to FIG. 14, the end surface 10*c* of the regulatory portion 10*d* is in the form of a disc and is flat. Therefore, the regulatory portion 10*d* is as effective as the regulatory portion 10*b* in the first embodiment to dam up the developer as the developer is conveyed by the stirring screw 6.

Next, referring to FIG. 15(*a*), the regulatory portion 10*d* is also provided with a tapered portion 10*e*, which is located next to the stirring screw 6, and across which the diameter of the rotational shaft 10*a* gradually increases toward the regulatory portion 10*d* in the pattern of a hyperbolic curve. The tapered portion 10*e* gradually increases in diameter in the adjacencies of the downstream end of the return screw 10, and steplessly connects to the peripheral portion of the regulatory portion 10*d*.

Referring to FIG. 14, the lower the rotational speed, the gentler the developer flow indicated by an arrow mark P1 which is generated as the developer is conveyed toward the regulatory portion 10*b*, the pulsation of the developer flow indicated by an arrow mark P2 which occurs as the developer is reversely conveyed from the development chamber 14, and the changes in the height of the developer flow surface. Further, even if the rotational speed of the return screw 10 is slow, the developer having flowed over the regulatory portion 10*d* is pushed back toward the stirring screw 6 by the rotation of the spiral blade of the return screw 10.

Generally speaking, in a case where developer is conveyed by a screw which has a spiral blade, the developer is subjected to such a force that is generated by the centrifugal force and the inclination of the surface of the spiral blade which extends upstream, and also, that pushes the developer outward in terms of the radius direction of the screw. Therefore, in a case where the regulatory portion 10*b* is provided as in the first embodiment as shown in FIG. 10, the centrifugal force which acts on the developer is substantial as long as the rotational speed is substantial. Therefore, the developer is pushed back toward the stirring screw 6 with no problem.

However, in a case where the rotational speed is low, the centrifugal force is insufficient. Therefore, as the developer flows to the return screw 10 over the regulatory portion 10*b*, the force generated by the return screw 10 is sometimes insufficient to cause the developer to flow over the regulatory portion 10*b* and return to the stirring screw 6. The portion of the developer flow, which fails to flow to the stirring screw 6 over the regulatory portion 10*b*, is pushed toward the discharge passage 13 and is discharged.

Referring to FIG. 15(*b*), in the second embodiment, therefore, the rotational shaft 10*a* is shaped so that it gradually increases in diameter toward its downstream end in terms of the conveyance direction to steplessly connect to the peripheral edge of the end surface 10 of the return screw 10. With the provision of this structural arrangement, the developer flow from the stirring screw 6 is regulated by the end surface 10*c*, and the developer having flowed over the end surface 10*c* is pushed up by the tapered portion 10*e* of the return screw 10, and therefore, is returned to the stirring screw 6.

Referring to FIG. 15, by the way, the return screw 10 is structured so that its tapered surface 10*e* is hyperbolically contoured. More specifically, the tapered portion 10*e* is smallest in diameter at roughly the center of the return screw 10 in terms of the direction parallel to the rotational axis of the return screw 10, and gradually increases in diameter toward the most downstream end of the return screw 10, and becomes the same as that of the return screw 10 (diameter of spiral blade) at the most downstream end. However, the same effect as the effect obtainable by this embodiment can be obtained by shaping the rotational shaft 10*a* in such a manner that it gradually increases in diameter toward the downstream end of the return screw 10 in terms of the conveyance direction. That is, this embodiment is not intended to limit the present invention in scope in terms of the shape of the return screw 10.

(Miscellanies)

The present invention is applicable to developing devices which are partially or entirely different in structure from those similar to the developing devices 1 in the preceding embodiments, as long as they are structured so that a developer damming member which is circularly continuous in terms of the rotational direction of the conveyance screw 5 is disposed between the two conveyance screws which are opposite in the developer conveyance direction. That is, the preceding embodiments are not intended to limit the present invention in scope in terms of the measurement, material, and shape of the structural components, and the positional relationship among the structural components, unless specifically noted. They are not intended to limit the weight ratio of the carrier of the replenishment developer to 10%. The regulatory portions 10*b* and 10*b* may be angled. Further, the regulatory portions 10*b* and 10*d* may be provided with slits, holes, etc., as long as they can prevent the amount by which developer is discharged, from changing.

Further, in the preceding embodiments, the regulatory portion 10*b* and return screw 10 were continuous. However, they may be separated from each other in terms of the direction parallel to their axial line.

Further, the present invention is applicable to a developing device, regardless of whether the image forming apparatus which employs the developing device is of the single drum type or tandem type, of the single-component developer type or two-component developer type, and intermediary transfer type or direct transfer type. Further, the present invention is applicable to a developing device, regardless of the image bearing member count, image bearing member charging method, electrostatic image forming method, developing method, transferring method, fixing method, etc., of the image forming apparatus by which the developing device is employed. In the foregoing, only the portions of the image forming apparatus, which are essential to the formation and transfer of a toner image were described. However, the present invention is also compatible with image forming apparatuses other than those in the preceding embodiment. For example, it is compatible with various printers, copying machines, facsimile machines, multifunction machines capable of performing two or more of the preceding machines, etc., which are a combination of the image forming apparatus in the preceding embodiments, and additional devices, equipments, casing, etc.

According to the present invention which is related to a developing device, as the first bladed member causes developer to flow to the second bladed member, the regulatory member regulates the developer flow regardless of its rotational phase. Therefore, it is prevented that the amount, by which developer is discharged, changes in synchronism with the rotational period of the second bladed member. Therefore, a developing device which regulates its developer discharge with the use of the second bladed member can be stabilized in the effect of regulatory member to minimize the change in the amount of developer discharge. Therefore, it is possible to reliably discharge developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 240731/2013 filed Nov. 21, 2013, which is hereby incorporated by reference.

What is claimed is:

1. A developing apparatus comprising:

a developing container for containing a developer comprising toner and carrier, said developing container including a first chamber configured to accommodate the developer, a second chamber provided adjacent to said first chamber in a direction crossing with a longitudinal direction of said first chamber and communicating with said first chamber to establish a circulation path along which the developer circulates, a partition between said first chamber and said second chamber, a first communication opening provided at one end portion side of said partition with respect to the longitudinal direction and configured to supply the developer from said first chamber into said second chamber, and a second communication opening provided at the other end portion side of said partition with respect to the longitudinal direction and configured to supply the developer from said second chamber into said first chamber;

a first rotatable feeding member provided in said first chamber and configured to feed the developer, said first feeding member including a rotatable shaft, a first helical blade portion provided around said rotatable shaft and configured to feed the developer, and a second helical blade portion provided around the rotatable shaft at a position downstream of said first helical blade portion with respect to a developer feeding direction of said first helical blade portion, said second helical blade portion having a helix which is opposed to that of said first helical blade portion:

a second rotatable feeding member provided in said second chamber and configured to feed the developer;

a discharge opening provided downstream of said second helical blade portion with respect to the developer feeding direction of said first helical blade portion and configured to permit discharge of the developer out of said developing container; and a disk portion provided on said rotatable shaft at a position between said first helical blade portion and said second helical blade portion.

2. An apparatus according to claim 1, wherein said disk portion is connected with said second helical blade portion.

3. An apparatus according to claim 1, wherein said disk portion overlaps with said first communication opening with respect to the rotatable shaft direction.

4. An apparatus according to claim 1, wherein said disk portion is spaced from said first helical blade portion with respect to the rotatable shaft direction.

5. An apparatus according to claim 1, further comprising a second disk portion provided opposed to said first disk portion with said second helical blade portion interposed therebetween.

6. An apparatus according to claim 1, wherein said rotatable shaft has a diameter in a downstream side of said disk portion with respect to the developer feeding direction of said first helical blade portion, and the diameter being larger than a diameter of said rotatable shaft in an upstream side of said disk portion with respect to the developer feeding direction of said first helical blade portion.

7. An apparatus according to claim 6, wherein said rotatable shaft has a diameter gradually decreasing toward a downstream side with respect to the developer feeding direction of said first helical blade portion in the downstream side of said disk portion with respect to the feeding direction of said first helical blade portion.

8. An apparatus according to claim 7, wherein said disk portion has an outer diameter equal to that of said second helical blade portion and connected with an upstream end of said second helical blade portion with respect to the developer feeding direction of said first helical blade portion.

* * * * *